US007144290B2

(12) United States Patent
Hitzschke et al.

(10) Patent No.: US 7,144,290 B2
(45) Date of Patent: Dec. 5, 2006

(54) DISCHARGE LAMP WITH STABILIZED DISCHARGE VESSEL PLATE

(75) Inventors: Lothar Hitzschke, München (DE); Frank Vollkommer, Buchendorf (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 78 days.

(21) Appl. No.: 11/132,932

(22) Filed: May 19, 2005

(65) Prior Publication Data

US 2005/0215166 A1 Sep. 29, 2005

Related U.S. Application Data

(62) Division of application No. 10/466,270, filed on Jul. 15, 2003.

(60) Provisional application No. PCT/DE02/02968, filed on Aug. 13, 2002, now Pat. No. 7,015,644.

(30) Foreign Application Priority Data

Sep. 27, 2001 (DE) ..... 101 47 728

(51) Int. Cl.
*H01J 9/00* (2006.01)

(52) U.S. Cl. ..... 445/26; 455/27; 455/43; 455/44

(58) Field of Classification Search ..... 455/16–18, 455/22, 26, 27, 43, 44
See application file for complete search history.

(56) References Cited

U.S. PATENT DOCUMENTS 5,479,069 A * 12/1995 Winsor ..... 313/493
5,509,841 A * 4/1996 Winsor ..... 445/26
5,693,170 A * 12/1997 Li ..... 156/299
5,807,154 A * 9/1998 Watkins ..... 445/25
5,850,122 A * 12/1998 Winsor ..... 313/493
5,903,096 A * 5/1999 Winsor ..... 313/493
6,036,567 A * 3/2000 Watkins ..... 445/25
6,075,320 A * 6/2000 Winsor ..... 315/94
6,114,809 A * 9/2000 Winsor ..... 315/50
6,127,780 A * 10/2000 Winsor ..... 315/56
6,218,776 B1 * 4/2001 Cull et al. ..... 313/493
6,294,867 B1 * 9/2001 Lynn ..... 313/422
6,518,691 B1 * 2/2003 Baba ..... 313/113
6,762,556 B1 * 7/2004 Winsor ..... 313/607
6,836,064 B1 * 12/2004 Yamada et al. ..... 313/485
7,029,358 B1 * 4/2006 Ando ..... 445/25

* cited by examiner

*Primary Examiner*—Nimeshkumar D. Patel

*Assistant Examiner*—Dalei Dong

(74) *Attorney, Agent, or Firm*—Robert F. Clark

(57) ABSTRACT

The invention relates to a new design of discharge vessel for a discharge lamp, in which dielectrically impeded discharges are to be generated. In this case, a discharge vessel plate 1, 9 is, as it were, of two-fold design, specifically as a first discharge vessel plate 1 with an external electrode set and, in addition, as a stabilizing plate 9 outside the first discharge vessel plate 1.

2 Claims, 2 Drawing Sheets

DISCHARGE LAMP WITH STABILIZED DISCHARGE VESSEL PLATE

CROSS REFERENCE TO RELATED APPLICATION

This application is a divisional of co-pending application Ser. No. 10/466,270, filed Jul. 15, 2003, now U.S. Pat. No. 7,015,644 which is the National Stage of International Application No. PCT/DE02/02968, filed Aug. 13, 2002.

TECHNICAL FIELD

The present invention relates to a discharge lamp that is designed for dielectrically impeded discharges. Such discharge lamps have an electrode set with the aid of which dielectrically impeded discharges are generated in a discharge medium. The discharge medium is arranged for this purpose in a discharge space that is bounded by a discharge vessel of the discharge lamp. The dielectrically impeded discharges are distinguished in that there is provided between at least a portion of the electrode set and discharge medium a dielectric layer that forms the dielectric impediment from which the name comes. In the case of lamps where it is stipulated which electrodes operate as cathodes and which as anodes, at least the anodes are separated in this case by the dielectric layer of the so-called dielectric barrier from the discharge medium. Since such discharge lamps have been known for some time, various details of the general design of discharge lamps for dielectrically impeded discharges will not be considered further.

PRIOR ART

Discharge lamps for dielectrically impeded discharges are of particular interest since it has become known that relatively high efficiencies in the generation of UV light and, with suitable phosphors, other light as well, in particular visible light, can be generated with the aid of a pulsed operating mode (U.S. Pat. No. 5,604,410). Inter alia, interest attaches in this case to lamps which are also designated as flat radiators and in the case of which the discharge space is located between two discharge vessel plates that are substantially plane-parallel as a rule and of which at least one is at least partially transparent. Of course, it is possible in this case to provide a phosphor layer that is not directly transparent in the actual sense. Flat radiators are of interest, for example, for backlighting displays, monitors and the like.

SUMMARY OF THE INVENTION

The present invention is based on the problem of specifying a discharge lamp, designed for dielectrically impeded discharges, of improved design.

The invention is directed, firstly, to a discharge lamp having two discharge vessel plates between which a discharge space is arranged, and an electrode set for generating dielectrically impeded discharges in the discharge space, which electrode set is arranged on a side, averted from the discharge space, of a first one of the discharge vessel plates, the first discharge vessel plate forming a dielectric barrier between the electrode set and the discharge space, characterized in that the first discharge vessel plate is supported on its side facing the electrode set by a stabilizing plate.

The invention is further directed to a method for producing such a discharge lamp, in which there is produced a discharge vessel having two discharge vessel plates between which a discharge space is arranged, an electrode set for generating dielectrically impeded discharges being arranged in the discharge space on a side, averted from the discharge space, of a first one of the discharge vessel plates, and the first discharge vessel plate forming a dielectric barrier between the electrode set and the discharge space, characterized in that the first discharge vessel plate is supported on its side facing the electrode set by a stabilizing plate.

Preferred embodiments are specified in the dependent claims.

The invention proceeds in this case from the fact that it is known per se in the case of discharge lamps for dielectrically impeded discharges to arrange the electrodes or a portion of the electrodes outside the discharge vessel and utilize a corresponding portion of the discharge vessel wall as dielectric barrier. Since the discharge vessel walls consist as a rule of glass, they are well suited per se for this function. However, the discharge vessel walls must also fulfil mechanical tasks and are therefore approximately a few mm thick, depending on application. This holds the more so for the flat radiators considered here, in the case of which the plates must be designed to be relatively solid because of geometrical reasons. In order to be able to ignite and operate discharges in such discharge lamps, however, it is necessary to apply comparatively high voltages to the electrodes. This is attended, however, by an increased outlay in the design of the electric supply, that is to say the electronic ballast, and in the safety design.

On the other hand, there are also difficulties associated with the internal electrodes frequently used to date, in particular as regards the production of the dielectric coating, which is then to be applied separately. Specifically, this dielectric coating must satisfy relatively high demands with regard to the accuracy and the uniformity of the material thickness, and with regard to the freedom from gaps. This is certainly possible in principle, but is associated with a technical outlay that causes high costs, and with an unavoidable wastage.

In accordance with the invention, it is provided to use one discharge vessel wall, specifically one of the two discharge vessel plates, as dielectric barrier, but to design this plate to be relatively thin in order to be able to take account more effectively the electrical aspects and the optimization of the supply concerning the thickness of the dielectric barrier, or to measure the thickness of the dielectric barrier in the individual case exclusively according to such criteria.

Consequently, the discharge vessel plate (here also designated as first discharge vessel plate) bearing the electrodes is provided, as it were, in two-fold fashion. Firstly, as the actual first discharge vessel plate that bears the electrodes and forms the dielectric barrier, and secondly as an additional stabilizing plate that supports the first discharge vessel plate and stabilizes it mechanically. The electrodes are therefore located in the case of the finished discharge lamp between the first discharge vessel plate, on the one hand, and the stabilizing plate, on the other hand (but not necessarily directly therebetween). It is to be noted here, moreover, that these designs need not apply to all the electrodes of the discharge lamp, but can hold only for a portion of the electrodes, preferably for the portion that is to have a dielectric barrier. It is in this sense that the term "electrode set" is also to be understood in the claims.

The stabilizing plate can preferably be a continuous plate, for example a glass plate, as it would serve conventionally as discharge vessel plate. The term "stabilizing plate" is to be understood, however, very comprehensively with regard to the geometry and implies merely that the stabilizing plate can act in a stabilizing fashion in a flat sense. It need not necessarily be continuous for this purpose, and can thus also have cutouts, recesses and the like. There can also be a grid design, for example. It is advantageous, however, when the stabilizing plate forms a touch guard with regard to the electrodes, which are supplied with high voltage.

In addition, of course, other materials than glass are also conceivable, in particular with regard to other additional functions, as well. For example, the stabilizing plate could serve simultaneously for mounting, as cooling element or as electromagnetic shield, and therefore be fabricated from plastics or metals or other materials. In addition, the first discharge vessel plate also need not necessarily be constructed from glass. It need only consist of a dielectric that makes the necessary electric data available, it being possible to adapt the plate thickness as appropriate.

In principle, the stabilizing plate can already perform its function whenever it supports and stabilizes the comparatively thin first discharge vessel plate only by virtue of the fact that it is connected to the remaining, that is to say second, discharge vessel plate or to a frame connected thereto, that is to say is in any case a stabilizing part of the discharge vessel. The stabilizing plate then takes over a part of the mechanical stabilization of the overall discharge vessel, which is taken over conventionally by the first discharge vessel plate. In addition, the stabilizing plate can in this case also protect the first discharge vessel plate against damage from outside—even protect against the outside pressure in the case of a tight external seal. In addition, the first discharge vessel plate and the stabilizing plate can, of course, be interconnected continuously in a planar fashion. However, it is preferred according to the invention that the connection between two plates is performed only at points, although these points are provided in relatively large numbers and distributed over the surfaces of the plates. In particular, in the case of the arrangement of the connecting points it is possible to have regard to the pattern of the electrode set or other boundary conditions. Moreover, the connecting operation can be performed in this way more simply or with less use of material. For example, bonding, welding, soldering or fusing of the plates come into consideration as connecting methods.

In the case of flat radiators, support elements are frequently provided between the discharge vessel plates, in particular in the case of large flat radiator formats. These support the discharge space against a possible external overpressure and shorten the bending lengths. The connecting points according to the invention between the first discharge vessel plate and the stabilizing plate should in this case preferably be provided so tightly that at most only the bending lengths defined by these support elements result. However, the spacings between the connecting points are preferably yet more clearly smaller, for example at most half as large as the bending lengths provided by the support elements.

It is possible in this case to provide a geometric tuning between the arrangement of the support elements and the arrangement of the connecting points. For example, the connecting points or a few of them can be provided substantially at the same points (perpendicular to the plates in the corresponding projection) as the support elements. Any possible further connecting points can then subdivide the spaces between the connecting points thus arranged. A tuning between the arrangement of the support elements and the arrangement of the connecting points is also suggested because the aim is possibly to take account in both arrangements of the pattern of the electrode set and the pattern of the discharges that is associated therewith.

The first discharge vessel plate can, moreover, bear a phosphor layer on the side averted from the electrode set, and/or also have a reflector layer. Moreover, it would also be possible for further electrodes to be provided on this side which then likewise do not belong to the electrode set arranged according to the invention on the other side, in particular cathodes.

Favorable numerical values for the thickness of the first discharge vessel plate can be between 0.1 and 0.8 mm, preferably between 0.2 and 0.7 mm and, with particular preference, between 0.3 and 0.6 mm. The stabilizing plate, in turn, can have a thickness of between 0.4 mm and 3 mm, but is not restricted to this range.

Particular preference is given to a structure of the second discharge vessel plate in the case of which the latter on the one hand is transparent, and on the other hand has a frame projection of integrated design for externally sealing the discharge space, and support elements, designed in a fashion integrated in the second discharge vessel plate, for the support in relation to the first discharge vessel plate. Reference may be made for further details of this discharge lamp structure to the previous applications WO 02/27761 and WO 02/27759 of the same applicant.

A variant of the invention consists in connecting the first discharge vessel plate to the second discharge vessel plate, on the one hand, and to the stabilizing plate, on the other hand, in one and the same method step. This relates specifically to connection techniques in the case of which the participating parts must be heated. It is then possible for the entire discharge vessel structure, at least the three plates mentioned, to be connected in a common heating step.

In this case, it is preferred to make use between the two discharge vessel plates of spacers that firstly maintain between these discharge vessel plates a spacing that serves for filling the discharge vessel with a discharge medium. After the filling, the temperature can then be raised so far that the spacers soften and the upper one of the two discharge vessel plates sinks onto the lower one. Their own weight, or else an additional weighting can serve for this purpose.

The connection between the first discharge vessel plate and the stabilizing plate can also be performed in a similar way, and specifically as already mentioned, preferably simultaneously with the connection between the two discharge vessel plates. The spacers could consist of SF6 glass that has a softening point in a suitable temperature range. If the solders cause slight contamination or none, it is also possible to dispense with spacers at this point, and so the first discharge vessel plate and the stabilizing plate can be laid directly on one another from the start. It is then possible at the abovementioned temperature to fuse solder glass points, for example, at the connecting points, in order to connect the first discharge vessel plate and the stabilizing plate.

BRIEF DESCRIPTION OF THE DRAWINGS

An exemplary embodiment is described below with the aid of the figures. In this case, disclosed individual features can also be essential to the invention in combinations other than those illustrated.

In detail.

PREFERRED DESIGN OF THE INVENTION

Figure 1:
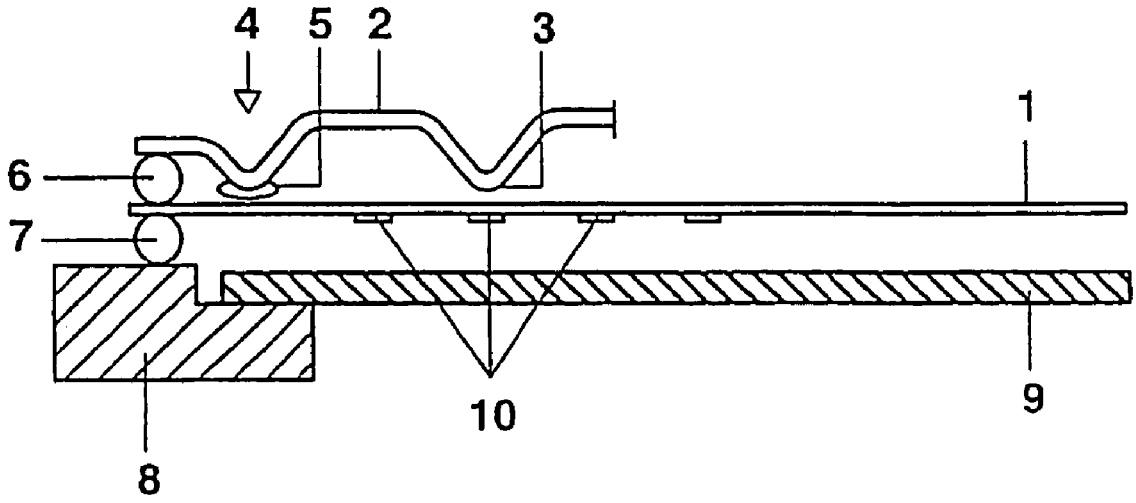
FIG. 1 shows a cross sectional illustration of a detail of a discharge lamp according to the invention before it is finished.

FIG. 1 shows an illustration of a detail in a cross section through a discharge lamp whose structural details correspond, leaving aside the present invention, to the illustrations in the earlier applications WO 02/27761 and WO 02/27759 of the same applicant. 1 designates a first discharge vessel plate, the thickness of the glass plate being 0.4 mm. 2 designates a second discharge vessel plate, specifically a transparent glass plate which has a thickness of approximately 1 mm and serves here as cover plate and for the exit of light. The second discharge vessel plate 2 has a structure with inwardly pointing supporting projections 3 which are of integral design and run to a point onto the first discharge vessel plate 1, for which purpose reference may be made to the already cited applications. In the outer, that is to say in FIG. 1 left, region, the second discharge vessel plate 2 has a frame 4, likewise of integral design, of which the underside, facing the first discharge vessel plate 1, bears a solder glass material 5.

Outside the frame 4, an outermost region of the second discharge vessel plate 2 rests on a spacer 6 made from SF6 glass, the arrangement actually lying in front of and behind the plane of the drawing, as follows from FIG. 2. The spacer 6 supports the second discharge vessel plate 2 against the first discharge vessel plate 1 and on the other hand leaves a passage to the (later) discharge vessel interior between the discharge vessel plates 1 and 2. In the state illustrated in FIG. 1, the discharge vessel can therefore be rinsed and filled from the plates 1 and 2.

The first discharge vessel plate 1 rests over a further spacer 7, which corresponds otherwise to the spacer 6, on a support 8 which serves only to produce the discharge vessel and does not belong to the discharge vessel itself. Furthermore, a stabilizing plate 9, specifically a glass plate with a thickness of approximately 1 mm, rests on the support 8. In the state illustrated in FIG. 1, the spacer 7 ensures an intermediate spacing between the first discharge vessel plate 1 and the stabilizing plate 9.

Provided on the side, lower in accordance with FIG. 1, of the first discharge vessel plate 1 are electrodes (not illustrated in the figure) made from silver (Ag), which are therefore separated from the (later) discharge space between the two plates 1 and 2 by the first discharge vessel plate 1. Distributed furthermore on the same lower side of the first discharge vessel plate 1 are solder glass points 10, concerning the arrangement of which reference is also made to FIG. 2. In FIG. 2, the solder glass points 10 are illustrated as points, and the supporting projections 3 as crosses. However, it is already to be seen in FIG. 1 that one of the solder glass points lies below the supporting projection 3 of the second discharge vessel plate 2, and a further one of the solder glass points 10 lies in the region of the frame 5.

Figure 2:
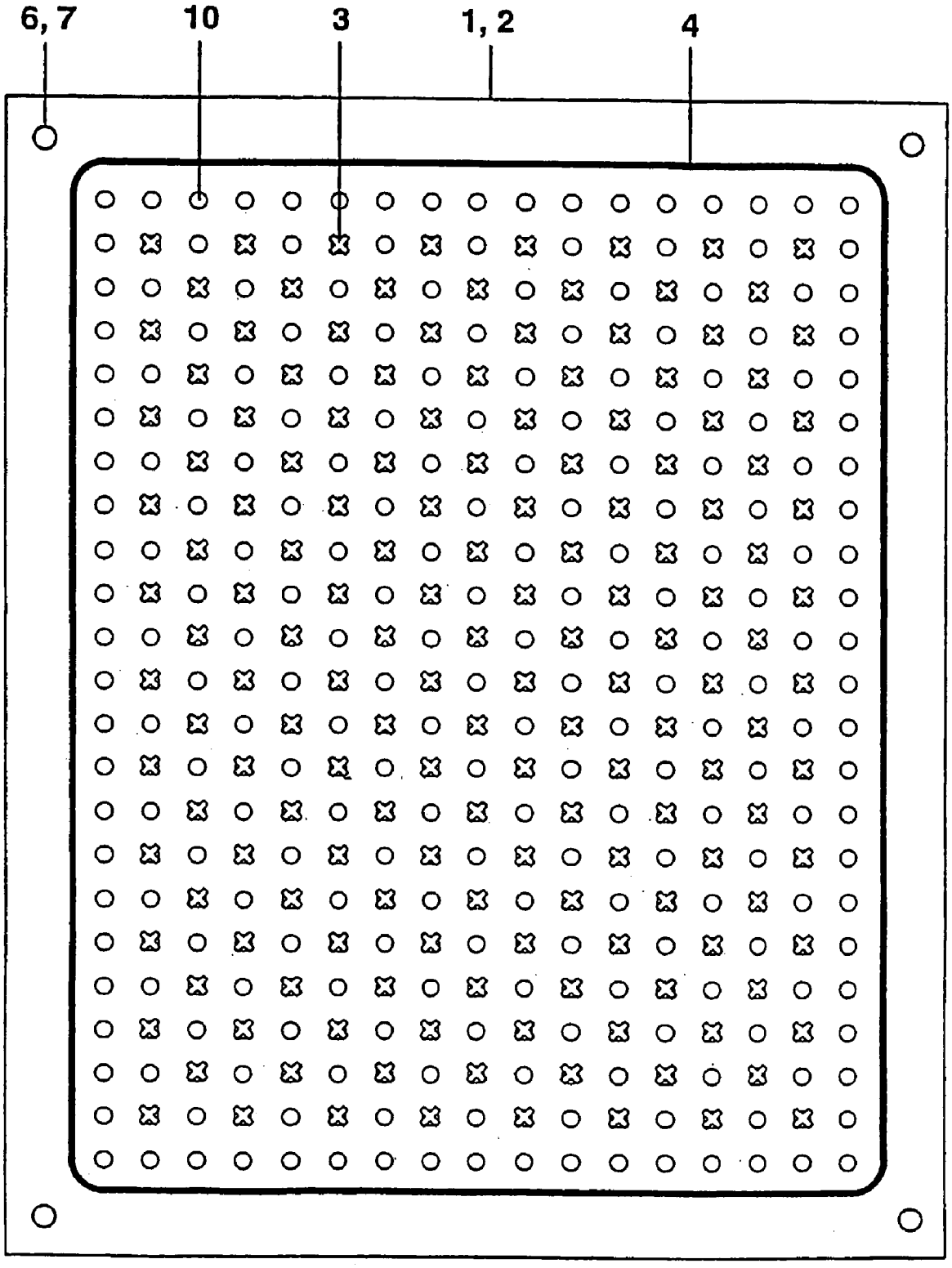
FIG. 2 shows a plan view of the discharge lamp from FIG. 1 for the purpose of illustrating the arrangement of solder glass points in FIG. 1.

FIG. 2 shows overall in a schematic plan view that the solder glass points 10 form a square grid, and the supporting projections 3 form a face-centered square grid, the grid spacing between the solder glass points 10 being half as large as that between the supporting projections 3. In this case, the two grids are aligned on one another, and so solder glass points 10 are below the supporting projections 3 in each case. The maximum bending lengths between the supporting projections 3 are consequently halved by a solder glass point 10 in each case. In FIG. 2, the spacers 6, 7 are illustrated in the outermost corners of the discharge vessel plates 1 and 2, but they could also lie at other points. However, it suffices when they hold the plates 1, 2 and 9 sufficiently apart from one another before the final closure (after the filling) of the discharge vessel.

According to the invention, after the filling of the discharge space between the plates 1 and 2 and the softening of the spacers 6 and 7, it is not only that the solder glass layer 5 below the frame 4 fuses with the first discharge vessel plate 1, but also the solder glass points 10 on the underside of the first discharge vessel plate 1 fuse with the stabilizing plate 9. As a result, the very thin first discharge vessel plate 1 is connected in a planar fashion to the stabilizing plate 9, and is thus stabilized by the stabilizing plate 9 both against external damage by impact or pressure, and also with regard to bending loads of the discharge vessel. In this exemplary embodiment, the interspace between the first discharge vessel plate 1 and the stabilizing plate 9 is not sealed in a vacuum-tight fashion, and so atmospheric pressure is present during operation between the two plates 1 and 9 and in the event of a (typical) underpressure in the interior of the discharge vessel a portion of the atmospheric pressure rests on the first discharge vessel plate 1. Since, however, the spacings between the solder glass points 10 are sufficiently small, even the thin discharge vessel plate 1 can withstand this external overpressure.

A reflector layer is firstly arranged on the top side of the first discharge vessel plate 1, and a phosphor layer is arranged above it. The dielectrically impeded discharges generated by electrodes between the plates 1 and 2 produce VUV radiation, which excites the phosphor layer to emit visible light. The reflector layer lying below the phosphor layer ensures optimization of the utilization of the visible radiation for emission upwards through the second discharge vessel plate 2.

The thickness of the first discharge vessel plate 1, which amounts to 0.4 mm, offers a favorable layer thickness for the dielectric barrier on the electrodes and requires no unnecessary outlay in the electrical supply of the discharge lamp. The stabilizing plate, in turn, ensures touch protection, which corresponds to a conventional variant with interior electrodes.

The invention claimed is:

1. A method for producing a discharge lamp comprising:

(a) providing a discharge vessel having first and second discharge vessel plates (1, 2) between which a discharge space is arranged, a stabilizing plate, and an electrode set being arranged on a side, averted from the discharge space, of the first discharge vessel plate, the first discharge vessel plate (1) forming a dielectric barrier between the electrode set and the discharge space, the discharge vessel plates and the first discharge vessel plate and the stabilizing plate being held apart by spacers, (b) filling the discharge space with a discharge medium, and (c) heating the discharge vessel to soften the spacers so that the two discharge vessel plates (1, 2) are interconnected, and the first discharge vessel plate (1) and the stabilizing plate (9) are interconnected.

2. The method of claim 1 wherein the second discharge vessel plate has inwardly pointing supporting projections bearing a solder glass material and the first discharge plate has solder glass points facing the stabilizing plate, during the heating of the discharge vessel, the solder glass material fuses with the first discharge vessel plate and the solder glass points fuses with the stabilizing plate.

* * * * *